US010836064B2

(12) United States Patent
Borges Fernandez et al.

(10) Patent No.: US 10,836,064 B2
(45) Date of Patent: Nov. 17, 2020

(54) COUNTER-DIE CYLINDER BLANKET OF DIE CUTTING MACHINE AND BLANKET MANUFACTURING PROCESS

(71) Applicant: RODICUT INDUSTRY, S.A.U., Mos (ES)

(72) Inventors: David Borges Fernandez, Vigo Pontevedra (ES); Joaquin Cabaleiro Cabaleiro, Cesantes Pontevedra (ES); Marcelino Alvarez Alvarez, Vigo Pontevedra (ES)

(73) Assignee: RODICUT INDUSTRY, S.A.U., Mos (ES)

( * ) Notice: Subject to any disclaimer, the term of this patent is extended or adjusted under 35 U.S.C. 154(b) by 0 days.

(21) Appl. No.: 16/096,583

(22) PCT Filed: Jun. 10, 2016

(86) PCT No.: PCT/ES2016/070440

§ 371 (c)(1),
(2) Date: Oct. 25, 2018

(87) PCT Pub. No.: WO2017/212083

PCT Pub. Date: Dec. 14, 2017

(65) Prior Publication Data

US 2019/0134841 A1 May 9, 2019

(51) Int. Cl.
*B26D 7/20* (2006.01)

(52) U.S. Cl.
CPC ..... *B26D 7/20* (2013.01); *B26D 7/204* (2013.01); *B26D 2007/202* (2013.01)

(58) Field of Classification Search
CPC .... B26D 7/204; B26D 2007/202; B26D 7/20; B26F 1/384; B21D 28/38; B21D 28/18; B23D 35/00; Y10T 83/4841; Y10T 83/9312
USPC ..... 83/13, 659, 347, 698, 331, 356.3, 346, 83/658, 511, 598.31, 698.41, 698.42
See application file for complete search history.

(56) References Cited

U.S. PATENT DOCUMENTS

| | | | | |
|---|---|---|---|---|
| 3,296,673 A * | 1/1967 | Kirkpatrick | B41F 27/1281 | 24/265 A |
| 3,885,486 A * | 5/1975 | Kirkpatrick | B26D 7/20 | 83/659 |
| 4,191,076 A * | 3/1980 | Bollmer | B26D 7/20 | 101/415.1 |
| 6,698,326 B2 * | 3/2004 | Elia | B26D 7/20 | 492/45 |

(Continued)

OTHER PUBLICATIONS

International Search Report and Written Opinion dated Mar. 16, 2017 for PCT/ES2016/070440 and English translation.

*Primary Examiner* — Ghassem Alie
(74) *Attorney, Agent, or Firm* — Lucas & Mercanti, LLP

(57) ABSTRACT

Counter-die cylinder blanket of die cutting machine comprising a band (3) of soft plastic material provided with a key (4), and an insert (5) of stiffening material housed in the key (4), wherein the insert (5) additionally comprises separating ribs (11) which extend from the top face (8) and/or from a bottom face (9) to facilitate the positioning of the insert (5) in the key (4) during the forming by moulding of the band (3) inside of a mould (16), and it preferably incorporates separating ribs (11) which extend from its side faces (10).

14 Claims, 2 Drawing Sheets

(56) References Cited

U.S. PATENT DOCUMENTS

| | | | | |
|---|---|---|---|---|
| 6,820,529 | B2 * | 11/2004 | Elia | B26D 7/20 83/347 |
| 2003/0041714 | A1 | 3/2003 | Neal et al. | |
| 2004/0231479 | A1 * | 11/2004 | Elia | B26D 7/20 83/347 |
| 2006/0191390 | A1 | 8/2006 | Neal | |

* cited by examiner

COUNTER-DIE CYLINDER BLANKET OF DIE CUTTING MACHINE AND BLANKET MANUFACTURING PROCESS

CROSS REFERENCE TO RELATED APPLICATION

This Application is a 371 of PCT/ES2016/070440 filed on Jun. 10, 2016, application which is incorporated herein by reference.

OBJECT OF THE INVENTION

The present invention relates to a counter-die cylinder blanket of a die cutting machine which incorporates an insert to give rigidity to the blanket, being especially devised for rotating-type die cutting machines used in cardboard processing for the manufacturing of packaging.

The invention has the object of the particular configuration of the insert, which guarantees its centred positioning in the blanket during the manufacturing process thereof, in addition to relating to the process for producing said blanket.

BACKGROUND OF THE INVENTION

The rotating-type die cutting machines generally comprise a pair of cylinders among which is made to pass through a sheet of cardboard for its die cutting, one of the cylinders of the pair incorporating a plurality of blades designed to make cuts in the sheet of cardboard whilst the other cylinder acts as a base for the die cutting.

This cylinder which acts as a base, generally known as counter-die cylinder, is usually made in high-resistance materials such as steel and, so that during the die cutting process no deterioration occurs in the blades, a coating is usually incorporated, also referred to as blanket, of a relatively soft material, which is typically polyurethane.

The blanket is generally materialized in a thick band of constant thickness designed to surround the cylinder, i.e. to form a type of cylindrical bushing concentric to the counter-die cylinder, a blanket which may incorporate a key designed to fit in a key seat defined in the counter-die cylinder.

Blanket bands are generally manufactured by means of filling by casting of a plastic material in fluid state at high temperatures in moulds of cylindrical geometry, with a key seat defined on the surface of the mould, to generate the key of the resulting band which, in this case constitutes the main fixing element of the band with the counter-die cylinder.

Solutions are known wherein the key of the band incorporates an insert which provides properties different or complementary to those of the material with which the band is manufactured, such as increasing rigidity of the key, improving quality of the closure of facilitating the assembly and dismantling procedure.

Said insert generally has an elongated geometry and may be subject to warping or torsions, both before being introduced in the key seat of the mould and on reaching certain temperatures during the band manufacturing process.

On the other hand, if it is desired that the insert is embedded in the band material during the hot pouring process thereof, it will be necessary for a certain clearance to be present with respect to the key seat wherein it is inserted, so that there is the risk that it displaces within said key seat, so that the final position in the blanket is not the desired one.

Finally, the introduction phase of the insert in the key seat during the manufacturing process of the blanket is especially critical if one wants a complete bond between the inset and the material of the band or key which surrounds it during filling. The walls of the key seat of the mould are typically impregnated, before the moulding operation, with a demoulding agent in order to facilitate the extraction of the band from the mould once the curing process of the poured plastic mass has finished.

In the event that the insert is not introduced centred in the mould key seat, it could establish direct contact with the walls of the key seat and, therefore, with the demoulding agent, and a correct adhesion would be produced of the insert in the key.

DESCRIPTION OF THE INVENTION

The object of the invention consists of a blanket designed to a counter-die cylinder comprising a band of plastic material of soft consistence, preferably polyurethane, which in turn has a key, obtained by means of moulding, and an insert of stiffening material of prismatic configuration housed in said key, which is formed by a body and a plurality of separating ribs which extend from the faces of the body.

The blanket is formed by moulding in a mould after the pouring of fluid plastic material and later curing, wherein the mould is formed by a cylindrical outer mould and a cylindrical inner mould provided with a key seat. The incorporation of the ribs in the insert facilitates their centring and separation with respect to the walls of the key seat of the inner mould, so that it avoids the aforementioned problems and drawbacks.

The incorporation of separating ribs will avoid that the main body of the insert is contaminated with the demoulding agent which will guarantee correct adhesion of the insert with the plastic material in liquid state during the moulding to produce the band.

The dimensions of the separating ribs defined on the faces of the stiffening insert are according to the separating distance that one wants to set between each one of the faces of the insert body and the walls of the mould key seat wherein it is designed to be housed.

The separating ribs are positioned uniformly throughout the surfaces of the insert body, preferably on those surfaces of the body parallel to the area of the mould key seat with the risk of presenting harmful agents for the adherence to the band during the filling of the mould, at a distance between them such that they guarantee the guiding parallel to a central shaft of said key seat of the mould from its insertion until its final position.

Likewise, said separating ribs have a round-tipped geometry which allows an easy sliding of the insert throughout the mould key seat, as well as its isolated contact during moulding. This geometry allows the adaptation to different dimensions of mould key seats maintaining an optimum adjustment, a continuous parallelism and final positioning. In this way, a first insert can be used in a predetermined range of width and depth of mould key seats.

It has also been preferably provided that the dimension of the body is in accordance with the mould key seat and that the separating ribs have the same height in order to guarantee the correct centring and positioning of the insert in the key seat of the mould.

In a first preferred embodiment, the insert comprises a plurality of upper and lower separators which emerge from the corresponding top and lower face of the body. This disposal makes it possible to overcome a series of problems, among which we can highlight the minimization of deficiencies in vulcanization, in those cases wherein a bond is desired between the insert and the rest of the band. Said deficiencies are usually mainly due to contamination by the demoulding agents impregnated in the mould key seat, which make contact with the insert body. On the other hand, it eliminates the torsions and warping by means of the guiding of the separators, guaranteeing that the polyurethane fixes the insert without their being trapping of air and the consequent bags.

In a second more preferred embodiment, the insert additionally comprises a plurality of side separators defined in its side faces.

To optimize contact and the bonding of the insert with the plastic material it is provided that the top face and/or the bottom face of said insert may incorporate grooves that extend longitudinally, preferably in the vicinity of the side faces, and the top face and/or the bottom face may have a rough surface, preferably a plurality of striations with geometry of saw tooth or undulating type, to increase adherence between the insert and the plastic material.

Additionally, and in the cases wherein one wants to guarantee good adhesion of the insert to the material poured on the mould once correctly positioned in the mould key seat, it is possible to previously perform several surface treatments on said insert, such as scoring, sandblasting, shot-blasting and/or gluing.

It is contemplated that, to facilitate the handling of the insert in the steps prior to its manual or automated introduction in the mould, said insert has additionally defined a handling area which enables the insertion in the key seat and, where relevant, guarantees the absence of undesired agents of the insert body in those cases wherein one wants a bond with the rest of the band material. This handling area may be removed in phases after the introduction, not forming part of the definitive piece.

On the other hand, it has been provided that the blanket may also incorporate a stiffening sheet, preferably fibre glass, which is normally separated by the upper ribs of the insert.

The manufacturing process of the blanket object of this invention uses a mould typically used in the mould-manufacturing of dollies formed by an inner mould provided with a key seat and an outer mould, concentric to the inner mould, between which a cavity is defined, wherein the blanket will be formed with the key.

The manufacturing process of the counter-die cylinder blanket of die cutting machine which is proposed in this invention incorporates, as a fundamental difference with respect to other processes, the step of introducing an insert of particular geometry, provided with separating ribs, which makes it possible to perform this introduction in a centred and guided form, parallel to the faces of the mould key seat as step prior to its filling with the manufacturing material of the blanket, which as has been indicated is preferably polyurethane in liquid state.

It also considers the possibility of introducing not only one but several inserts in the key seat, and which may be of any appropriate material.

DESCRIPTION OF THE DRAWINGS

To complement the description being made and in order to aid towards a better understanding of the characteristics of the invention, according to a preferred example of practical embodiment thereof, a set of drawings is attached as an integral part of said description wherein, with illustrative and non-limiting character, the following has been represented.

PREFERRED EMBODIMENT OF THE INVENTION

A detailed explanation is given below of examples of preferred embodiment of the object of the invention with the aid of the aforementioned figures.

Figure 1:
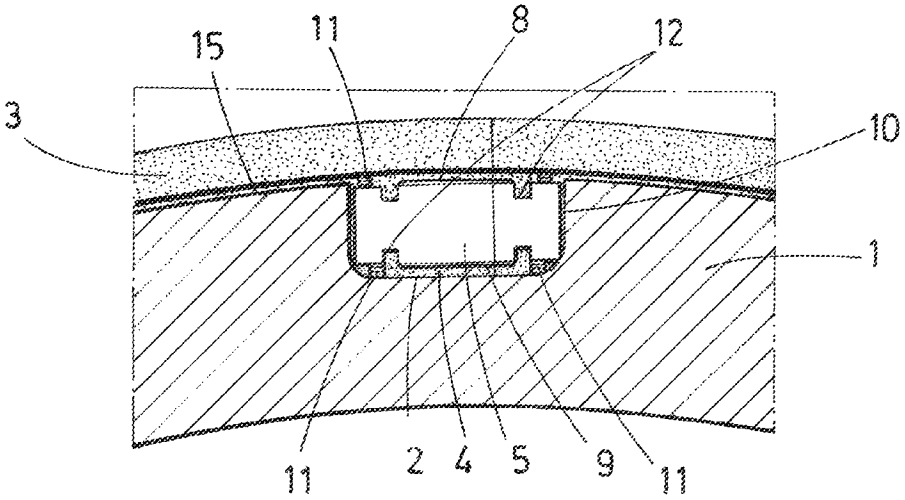
FIG. 1.—Shows an elevational view of a detail of a cross-section made in an assembly formed by the counter-die cylinder and the blanket according to a first preferred embodiment of the blanket, wherein the separating ribs defined in the insert are observed.

FIG. 1 shows a counter-die cylinder blanket of die cutting machine mounted on a counter-die cylinder (1) which has defined on its surface a key seat (2), said counter-die cylinder (1) being completely surrounded by a polyurethane band (3). The band (3) in turn comprises a key (4) housed in the key seat (2) of the counter-die cylinder (1), and inside of the key (4) is housed an insert (5).

Figure 2:
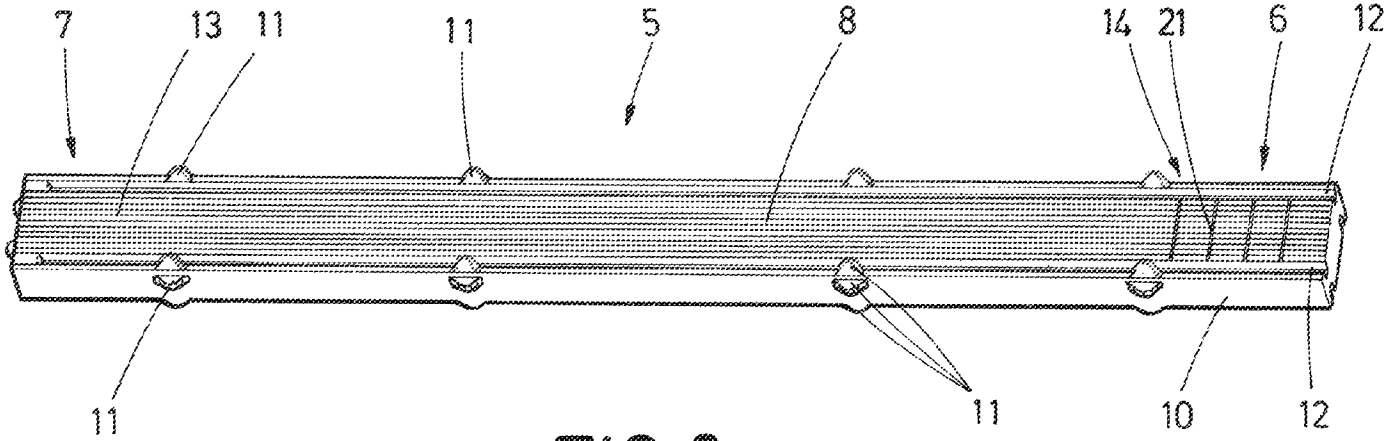
FIG. 2.—Shows a perspective view of the stiffening insert inserted in the key seat according to a second preferred embodiment wherein upper, lower and side separating ribs are observed.
Figure 3:
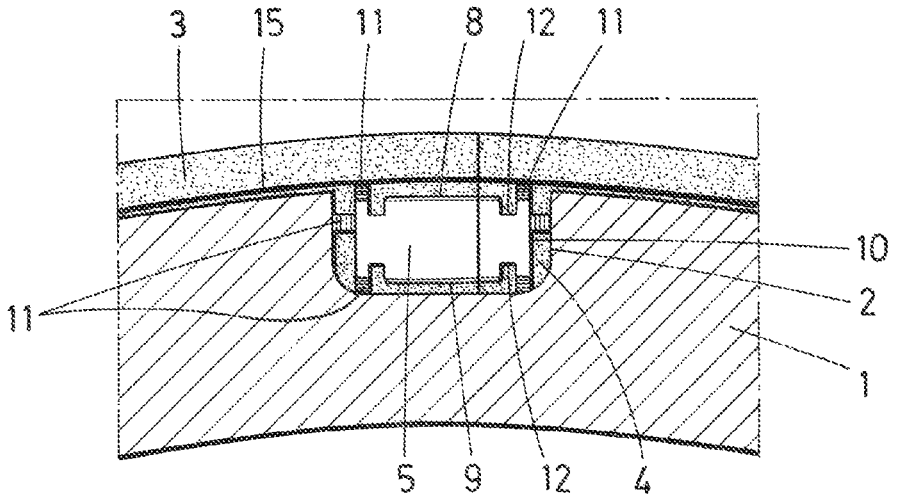
FIG. 3.—Shows an elevational view of a detail of a cross-section made in an assembly formed by the counter-die cylinder, a stiffening sheet and a blanket according to the second embodiment.
Figure 4:
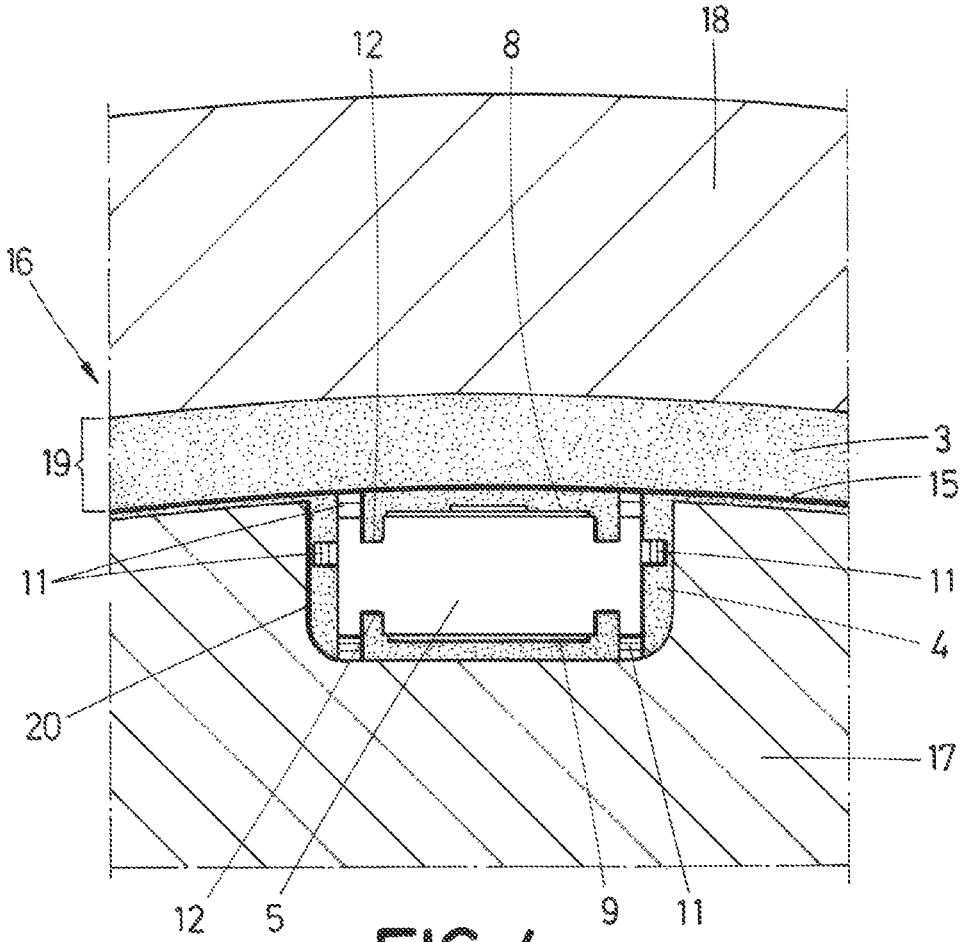
FIG. 4.—Shows an elevational view of a detail of the production of the blanket inside of a mould according to the second embodiment.

The insert (5), shown in FIGS. 1 to 4, is formed by a body of essentially parallelepiped geometry, provided with a front end (6), a rear end (7), a top face (8), a bottom face (9) and side faces (10), and a plurality of separating ribs (11) which emerge from the bottom face (9) and top face (8) in the first embodiment shown in FIG. 1, and which additionally emerge from the side faces (10) in the second embodiment, shown in FIGS. 2 to 4.

The insert (5) incorporates in the top face (8) different grooves (12) which extend longitudinally between the front end (6) and the rear end (7), as observed, for example, in FIGS. 1 and 2. Additionally, the surface of the top face (8) comprised between both grooves (12) has defined a plurality of striations (13) which extend longitudinally from the front end (6) to the rear end (7) of the insert (5).

It additionally contemplates that the insert (5) incorporates an extension or handling area (14) in its front end (6), as observed in FIG. 3, designed to be the place of gripping and handling of the insert (5) during its introduction in the mould (16), delimited by indicative lines (21).

It is also provided that the band (3) additionally comprises a layer of stiffening material (15), as observed in FIG. 3, which in this preferred embodiment is a fibre-glass sheet.

FIG. 4 shows a mould (16) used for the manufacturing of the blanket, which has an essentially cylindrical geometry, and comprising an inner mould (17) and an outer mould (18) concentric to the inner mould (17) between which is defined a cavity (19). On the surface of the inner mould (17) is a mould key seat (20) designed to form the key (4) of the band (3).

In the event one wants to form a blanket with a sheet of stiffening material (15), the manufacturing process starts with the positioning of said sheet of stiffening material (15)

inside of the cavity (19) of the mould (16), adjacent to the surface of the inner mould (17).

Subsequently, the insert (5) is introduced in the mould key seat (20), by means of the use of the separating ribs (11) for an introduction and guiding parallel to the faces of the mould key seat (20), and to achieve a centred positioning of the insert (5) inside of said mould key seat (20).

In that moment the plastic material constituting the blanket (1) is poured inside the cavity in fluid state, until filling the inner volume of said cavity (19), including the mould key seat (20) and the insert (5) introduced. Both the grooves (12) and the striations (13) defined in the insert (5) increase their surface and therefore increase the adherence of said insert (5) with the material of the band (3) surrounding it.

Additionally, the separating ribs (11) defined in the top face (8) of the insert (5) prevent the direct contact of this insert (5) with the sheet of stiffening material (15), avoiding contaminations and guaranteeing good adherence as it allows the entry of a layer of plastic material between the sheet of stiffening material (15) and the insert (5), as detailed in FIG. 4.

Then the blanket is extracted from the mould (16), producing a blanket with cylindrical cortex geometry, with the key (4) provided with an insert (5) embedded inside and the handling area of the insert is cut.

In FIG. 1, it is observed that the blanket is connected to the counter-die cylinder (1), covering its outer surface with the key (4) inserted in the key seat (2).

The invention claimed is:

1. A counter cylinder blanket for a die cutting machine comprising:

a key seat defined on a surface of the counter-die cylinder;

a band of soft plastic material designed to completely surround the counter-die cylinder including the key seat to provide therein a key of the band;

a sheet of stiffening material incorporated in the band of soft plastic material and outlining the counter-die cylinder blanket; and an insert of stiffening material housed inside the key of the band, the insert comprising a body having a front end, a rear end, a top face, a bottom face and side faces, wherein insert disposed inside of the key of the band is surrounded by the band of soft plastic, the body of the insert has a parallelepiped configuration and wherein the insert additionally comprises separating ribs which extend from the bottom face and/or the top face of the body of the insert, grooves that extend longitudinally along a length of the body, and a plurality of striations defined in the body of the insert to increase adherence between the insert and the band of soft plastic material.

2. The counter-die cylinder blanket according to claim 1, comprising separating ribs which extend from the side faces.

3. The counter-die cylinder blanket according to claim 1, wherein the grooves are defined in the top face of the body and/or the bottom face of the body of the insert, which extend longitudinally between the front end and the rear end.

4. The counter-die cylinder blanket according to claim 1, wherein the the plurality of striations defined in the top face and/or the bottom face of the insert.

5. The counter-die cylinder blanket according to claim 1, wherein in the plurality of striations have a saw tooth pattern.

6. The counter-die cylinder blanket to claim 1, wherein the plurality of striations have an undulated shape.

7. The counter-die cylinder blanket according to claim 1, wherein the insert additionally comprises a handling area defined in the front end designed to be manipulated during handling of the insert during introduction of the insert in the key seat, which is provided with lines of identification.

8. The counter-die cylinder blanket according to claim 1, wherein the sheet of stiffening material is made of fiber glass.

9. The counter-die cylinder blanket according to claim 1, wherein the soft plastic material of the band is polyurethane.

10. The counter-die cylinder blanket according to claim 1, wherein the separating ribs have a rounded tip.

11. The counter-die cylinder blanket according to claim 1, wherein the separating ribs have the same height.

12. A manufacturing process of the counter-die cylinder blanket according to claim 1, which makes use of a mould of essentially cylindrical geometry, comprising:

an inner mould, an outer mould concentric to the inner mould, a cavity defined between the inner mould and the outer mould, and a mould key seat defined in the surface of the inner mould, designed to create the key of the band, comprising the stages of:

introducing the insert in the mould key seat, by means of the use of the separating ribs for an introduction and guiding parallel to the faces of the mould key seat, and to achieve a centred positioning of the insert inside of said mould key seat, pouring inside the cavity of the mould the plastic material constituting the band in fluid state, until filling the inner volume of said cavity, including the mould key seat and the insert introduced, curing the plastic material poured, and extracting the band from the mould, and producing a band with cylindrical cortex geometry, with the key provided with an insert embedded inside.

13. The manufacturing process of the counter die cylinder blanket according to claim 12, further comprising the additional previous stage of positioning of a sheet of stiffening material inside of the cavity of the mould in a position adjacent to the surface of the inner mould.

14. The manufacturing process of the counter-die cylinder blanket according to claim 12, wherein after the curing the cutting is performed of the handling area of the insert.

* * * * *